US011141039B2

(12) United States Patent
Persson

(10) Patent No.: US 11,141,039 B2
(45) Date of Patent: Oct. 12, 2021

(54) DISHWASHER, METHOD AND CONTROL SYSTEM FOR HANDLING CLOGGING CONDITION

(71) Applicant: ELECTROLUX APPLIANCES AKTIEBOLAG, Stockholm (SE)

(72) Inventor: David Persson, Stockholm (SE)

(73) Assignee: Electrolux Appliances Aktiebolag

( * ) Notice: Subject to any disclaimer, the term of this patent is extended or adjusted under 35 U.S.C. 154(b) by 58 days.

(21) Appl. No.: 16/484,296

(22) PCT Filed: Feb. 24, 2017

(86) PCT No.: PCT/EP2017/054310

§ 371 (c)(1),
(2) Date: Aug. 7, 2019

(87) PCT Pub. No.: WO2018/153472

PCT Pub. Date: Aug. 30, 2018

(65) Prior Publication Data

US 2019/0357749 A1 Nov. 28, 2019

(51) Int. Cl.
*A47L 15/42* (2006.01)
*A47L 15/00* (2006.01)

(52) U.S. Cl.
CPC ..... *A47L 15/4208* (2013.01); *A47L 15/0023* (2013.01); *A47L 15/0031* (2013.01);
(Continued)

(58) Field of Classification Search
CPC ..... A47L 15/0023; A47L 15/0031; A47L 15/4208; A47L 15/0039; A47L 15/4244;
(Continued)

(56) References Cited

U.S. PATENT DOCUMENTS 2,882,366 A 4/1959 Fay
3,439,687 A 4/1969 Cushing
(Continued)

FOREIGN PATENT DOCUMENTS

CN 1 567 109 A 1/2005
CN 1909822 A 2/2007
(Continued)

OTHER PUBLICATIONS

Brushless DC electric motor—Wikipedia, the free encyclopedia [online] [retrieved Nov. 19, 2013]. Retrieved from the Internet: <URL: http://en.wikipedia.org/wiki/Brushless_DC_electric_motor>. 1 page.

(Continued)

*Primary Examiner* — Douglas Lee
(74) *Attorney, Agent, or Firm* — RatnerPrestia

(57) ABSTRACT

A method for handling a clogging condition in a dishwasher may include detecting the clogging condition; upon detecting the clogging condition, interrupting a wash cycle of the dishwasher and executing a remedial operation to remove the clogging condition. The remedial operation may include executing a drain operation for a predetermined drain time during which a drain pump may be continuously or intermittently operated to drain water from a sump of the dishwasher; following the drain operation, executing a fill operation for a predetermined fill time during which a fill valve may be continuously or intermittently activated to add water to the dishwasher; and following the fill operation, executing a circulation operation during which a circulation pump may be continuously or intermittently operated to remove the clogging condition. A dishwasher and a control system for handling a clogging condition are also provided.

14 Claims, 2 Drawing Sheets

(52) U.S. Cl.
CPC ..... *A47L 15/0039* (2013.01); *A47L 2401/03* (2013.01); *A47L 2401/07* (2013.01); *A47L 2401/12* (2013.01); *A47L 2501/01* (2013.01); *A47L 2501/30* (2013.01); *A47L 2501/34* (2013.01)

(58) Field of Classification Search
CPC ..... A47L 2401/03; A47L 2401/07; A47L 2401/09; A47L 2401/12; A47L 2501/01; A47L 2501/03; A47L 2501/05; A47L 2501/30; A47L 2501/34
See application file for complete search history.

(56) References Cited

U.S. PATENT DOCUMENTS 3,464,437 A 9/1969 Zane
3,835,880 A 9/1974 Hoffman et al.
3,844,299 A 10/1974 Athey et al.
3,846,615 A 11/1974 Athey et al.
3,986,372 A 10/1976 Karklys
4,069,425 A 1/1978 Cushing
4,097,307 A 6/1978 Geiger
4,180,095 A 12/1979 Woolley et al.
4,241,400 A 12/1980 Kiefer
4,245,310 A 1/1981 Kiefer
4,271,861 A * 6/1981 Crawford ..... A47L 15/4217 134/57 D
4,301,829 A 11/1981 Rowe
4,318,084 A 3/1982 Scott et al.
4,334,143 A 6/1982 Cushing
4,559,959 A 12/1985 Meyers
4,796,473 A 1/1989 Custer
5,018,550 A 5/1991 Burdorff
5,284,523 A 2/1994 Badami et al.
5,309,939 A 5/1994 Stickel et al.
5,330,580 A 7/1994 Whipple, III et al.
5,361,439 A 11/1994 Malchow
5,611,867 A 3/1997 Cooper et al.
5,669,983 A 9/1997 Cooper et al.
5,700,329 A 12/1997 Edwards et al.
5,755,244 A 5/1998 Sargeant et al.
5,762,080 A 6/1998 Edwards et al.
5,770,058 A 6/1998 Jozwiak
5,797,409 A 8/1998 Cooper et al.
5,806,541 A 9/1998 Cooper et al.
5,900,070 A 5/1999 Jarvis et al.
5,909,743 A 6/1999 Thies et al.
5,957,144 A 9/1999 Neff et al.
6,007,640 A 12/1999 Neff et al.
6,103,017 A 8/2000 Thies et al.
6,125,870 A 10/2000 Furmanek
6,129,110 A 10/2000 Kolb
6,182,674 B1 2/2001 Jozwiak et al.
6,432,216 B1 8/2002 Thies
6,544,344 B2 4/2003 Hegeman et al.
6,615,853 B2 9/2003 Hegeman et al.
6,655,922 B1 12/2003 Flek
6,752,875 B2 6/2004 Kiesler et al.
6,811,617 B2 11/2004 Elick et al.
6,887,318 B2 5/2005 Bashark
6,997,193 B2 2/2006 Elick et al.
7,064,514 B2 6/2006 Iwaji et al.
7,064,517 B2 6/2006 Kiuchi et al.
7,146,670 B2 12/2006 McGill et al.
7,146,992 B2 12/2006 Elick et al.
7,232,494 B2 6/2007 Rappette
7,241,347 B2 7/2007 Elick et al.
7,252,101 B2 8/2007 Elick et al.
7,255,113 B2 8/2007 Elick et al.
7,409,961 B2 8/2008 Elick et al.
7,472,711 B2 1/2009 Johnson et al.
7,472,712 B2 1/2009 Ashton et al.
7,472,714 B2 1/2009 Elick et al.
7,520,283 B2 4/2009 Lee
7,556,050 B2 7/2009 Lee
7,681,582 B2 3/2010 Wetzel et al.
7,776,159 B2 8/2010 Hooker et al.
7,789,968 B2 9/2010 Elick et al.
8,295,984 B2 10/2012 Heisele et al.
8,439,052 B2 5/2013 Klein
8,702,874 B2 4/2014 Montgomery et al.
9,192,280 B2 11/2015 Montgomery et al.
9,872,597 B2 1/2018 Pers et al.
10,178,936 B2 1/2019 Poyner et al.
2001/0017145 A1 8/2001 Rosenbauer et al.
2002/0108441 A1 8/2002 Liu
2003/0034749 A1 2/2003 Zinke et al.
2003/0056300 A1 3/2003 Ruhl et al.
2004/0099287 A1 5/2004 Shin
2004/0255988 A1 12/2004 DuHack et al.
2005/0005952 A1 1/2005 Bashark
2005/0051201 A1 3/2005 Ashton et al.
2005/0236019 A1 10/2005 Bang
2005/0241675 A1 11/2005 Jung et al.
2006/0130878 A1 6/2006 Lee et al.
2006/0174917 A1 8/2006 Hedstrom et al.
2006/0219262 A1 10/2006 Peterson et al.
2006/0237035 A1 10/2006 Ferguson et al.
2006/0237048 A1 10/2006 Weaver et al.
2006/0237049 A1 10/2006 Weaver et al.
2006/0237052 A1 10/2006 Picardat et al.
2007/0017551 A1 1/2007 Hartogh
2007/0034236 A1 2/2007 Reichold
2007/0151579 A1 7/2007 Hooker et al.
2007/0163626 A1 7/2007 Klein
2007/0181156 A1 8/2007 Uz et al.
2007/0283982 A1 12/2007 Elick et al.
2008/0078243 A1 4/2008 Jeon et al.
2008/0163930 A1 7/2008 Ha
2009/0078288 A1 3/2009 Son
2010/0275953 A1 11/2010 Orue Orue et al.
2011/0038736 A1 2/2011 Hesterberg et al.
2011/0048459 A1 3/2011 Hesterberg et al.
2011/0126863 A1 6/2011 Kranzle et al.
2012/0000535 A1 1/2012 Poyner et al.
2012/0006355 A1 1/2012 Heidel et al.
2012/0006360 A1 1/2012 Rosenbauer
2012/0048302 A1 3/2012 Didat
2012/0048314 A1 3/2012 Vitan et al.
2012/0060874 A1 3/2012 Gnadinger et al.
2012/0266919 A1 10/2012 Kranzle et al.
2013/0048025 A1 2/2013 Heidel et al.
2014/0158163 A1* 6/2014 Montgomery ..... A47L 15/0018 134/18
2015/0305592 A1 10/2015 Pers et al.

FOREIGN PATENT DOCUMENTS

DE 30 21 081 A1 12/1981
DE 80 10 288 U1 8/1984
DE 34 30 639 A1 3/1986
DE 35 13 640 A1 10/1986
DE 36 23 081 A1 1/1988
DE 38 39 200 A1 5/1990
DE 40 22 439 A1 1/1992
DE 42 19 146 A1 12/1992
DE 42 38 450 A1 5/1994
DE 43 10 403 A1 10/1994
DE 44 00 877 A1 7/1995
DE 44 00 887 A1 8/1995
DE 94 06 281 U1 9/1995
DE 44 41 519 A1 5/1996
DE 197 50 266 A1 5/1999
DE 102 44 242 A1 3/2004
DE 102 44 243 A1 3/2004
DE 102 46 017 A 4/2004
DE 103 12 744 A1 9/2004
DE 10 2004 00307 A1 8/2005
DE 10 2004 022 682 B3 3/2006
DE 10 2006 013 312 B3 5/2007
DE 10 2007 041 313 A1 3/2009
DE 10 2007 052 091 A1 5/2009
DE 10 2008 020 475 A1 11/2009

(56) References Cited

FOREIGN PATENT DOCUMENTS

| | | | | |
|---|---|---|---|---|
| DE | 10 2008 029 910 | A1 | 12/2009 | |
| DE | 10 2011 000 287 | A1 | 7/2012 | |
| DE | 10 2011 003 688 | A1 | 8/2012 | |
| DE | 10 2014 105527 | B3 | 4/2015 | |
| EP | 0 669 099 | A2 | 8/1985 | |
| EP | 0 326 893 | A2 | 8/1989 | |
| EP | 0 461 722 | A1 | 12/1991 | |
| EP | 1 112 016 | A1 | 7/2001 | |
| EP | 1 284 540 | A2 | 2/2003 | |
| EP | 1 464 268 | A2 | 10/2004 | |
| EP | 1 512 363 | A | 3/2005 | |
| EP | 1 574 161 | A1 | 9/2005 | |
| EP | 1 737 332 | A1 | 1/2007 | |
| EP | 2 213 217 | A1 | 8/2010 | |
| EP | 2 248 935 | A1 | 11/2010 | |
| EP | 2 407 078 | A2 | 1/2012 | |
| EP | 2 609 845 | A1 | 7/2013 | |
| EP | 2 672 875 | A1 | 12/2013 | |
| GB | 2 038 171 | | 7/1980 | |
| GB | 2 123 148 | A | 1/1984 | |
| GB | 2 139 084 | A | 11/1984 | |
| JP | H02302239 | A | 12/1990 | |
| JP | H05 115414 | A | 5/1993 | |
| JP | H0819506 | A | 1/1996 | |
| JP | 2002065566 | A | 3/2002 | |
| JP | 2002065567 | A | 3/2002 | |
| JP | 2006 006 766 | A | 1/2006 | |
| JP | 2011 143 130 | | 7/2011 | |
| KR | 10-2012-0022427 | | 3/2012 | |
| WO | WO 2005/070275 | A1 | 8/2005 | |
| WO | WO 2005/089621 | A1 | 9/2005 | |
| WO | WO 2006/116433 | A1 | 11/2006 | |
| WO | WO 2008/125482 | A2 | 10/2008 | |
| WO | WO 2009/027371 | A1 | 3/2009 | |
| WO | WO 2009/068391 | A1 | 6/2009 | |
| WO | WO 2009/156326 | A2 | 12/2009 | |
| WO | WO 2012/107264 | A1 | 8/2012 | |
| WO | WO 2012/146599 | A2 | 11/2012 | |
| WO | WO 2014/005650 | A1 | 1/2014 | |
| WO | WO 2014/106801 | A1 | 7/2014 | |
| WO | WO-2016155803 | A1 * | 10/2016 | ..... A47L 15/4229 |

OTHER PUBLICATIONS

EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.

International Search Report and Written Opinion for Application No. PCT/US2013/073553 dated Feb. 18, 2014, 11 pages.

International Search Report and Written Opinion for Application No. PCT/EP2015/076184 dated Feb. 8, 2016, 13 pages.

International Search Report and Written Opinion for Application No. PCT/EP2015/077675 dated Aug. 16, 2016, 9 pages.

International Search Report and Written Opinion for International Application No. PCT/EP2012/072203, dated Sep. 6, 2013, 12 pages.

International Search Report and Written Opinion for International Application No. PCT/EP2012/072204, dated Sep. 6, 2013, 10 pages.

International Search Report and Written Opinion for International Application No. PCT/EP2016/053132 dated Nov. 9, 2016, 10 pages.

International Search Report and Written Opinion for Application No. PCT/US2011/038986 dated Oct. 23, 2012, 19 pages.

International Search Report and Written Opinion for Application No. PCT/EP2017/054310 dated Mar. 27, 2017, 8 pages.

Office Action for Chinese Application No. 201280076924.9 dated Oct. 10, 2016.

Office Action from corresponding European Patent Application No. 12805600.9 dated Feb. 10, 2017.

Office Action from corresponding European Patent Application No. 12805601.7 dated Sep. 23, 2016.

Notice of Allowance for U.S. Appl. No. 13/708,530 dated Jul. 21, 2015.

Notice of Allowance for U.S. Appl. No. 13/022,942 dated Jan. 13, 2014.

Notice of Allowance for U.S. Appl. No. 15/391,933 dated Sep. 11, 2018.

Notice of Allowance for U.S. Appl. No. 14/439,346 dated Sep. 20, 2017.

Notice of Allowance for U.S. Appl. No. 14/439,351 dated Nov. 15, 2018.

Office Action for U.S. Appl. No. 14/439,346 dated Dec. 5, 2016.

Office Action for U.S. Appl. No. 14/439,351 dated Aug. 18, 2017.

Office Action for U.S. Appl. No. 14/439,351 dated May 16, 2018, 10 pages.

Office Action from U.S. Appl. No. 14/439,346 dated Aug. 31, 2016.

Office Action from U.S. Appl. No. 14/439,351 dated Apr. 21, 2017.

Office Action for U.S. Appl. No. 13/022,942 dated Jun. 23, 2013.

Office Action for U.S. Appl. No. 13/708,530 dated Apr. 2, 2015.

Office Action for U.S. Appl. No. 13/708,530 dated Sep. 4, 2014.

Office Action for U.S. Appl. No. 13/708,520 dated Dec. 24, 2014.

* cited by examiner

DISHWASHER, METHOD AND CONTROL SYSTEM FOR HANDLING CLOGGING CONDITION

CROSS-REFERENCE TO RELATED APPLICATIONS

This application is a national stage application filed under 35 U.S.C. § 371 of International Application No. PCT/EP2017/054310 filed Feb. 24, 2017, which application is hereby incorporated by reference herein in its entirety.

TECHNICAL FIELD

The present invention generally relates to the handling of a clogging condition in a dishwasher. In particular, a method for handling a clogging condition in a dishwasher in which a remedial operation comprising a drain operation, a fill operation and a circulation operation is executed, a dishwasher configured to handle a clogging condition, and a control system for handling a clogging condition in a dishwasher, are provided.

BACKGROUND

Dishwashers have become an integral part of everyday household use. Typical dishwashers use water pumped into a tub to clean dishes and utensils during wash cycles. The dishwasher may comprise a sump and a filter between the tub and the sump. The filter separates food soils from wash water. The wash water falls through the filter to a circulation pump that recirculates the water through the tub via spray arms. The soils exit the tub through the drain or is manually removed after completion of a wash cycle. Sometimes, however, the filter can become clogged with soils, overwhelming the filter and preventing or slowing the passing of wash water through the filter. In this case, a lack of water below the filter causes the circulation pump to suck in air, which may cause the circulation pump to become starved (run dry), lose its prime, or stop pumping altogether. These conditions may ultimately damage the circulation pump if not treated quickly.

US 2014158163 A1 discloses a method for detecting and removing a clogging condition of a filter in a dishwasher. The method comprises determining at least one of a normal water level for a wash cycle of the dishwasher or a normal rate at which the water level changes during the wash cycle; monitoring at least one of a water level during execution of the wash cycle or a rate at which the water level changes during execution of the wash cycle; detecting the clogging condition of the filter, wherein the clogging condition is indicated by at least one of a deviation of the monitored water level from the normal water level or a deviation of the monitored rate of water level change from the normal rate of water level change; determining a current position of the wash cycle being executed; executing a remedial operation to facilitate removal of the clogging condition from the filter; determining if the clogging condition has been removed following execution of the remedial operation; and resuming operation of the dishwasher based at least on the current position if the clogging condition has been removed.

SUMMARY

Prior art dishwashers comprising clogging condition remedial operations do often not recover once a clogging condition has occurred. The risk for the clogging condition to remain increases depending on the severity of the clogging condition. User interaction is often required to manually clean the clogged component, such as a filter, and restart the program to obtain desired cleaning result.

One object of the present disclosure is to provide a method for handling a clogging condition in a dishwasher enabling a, simple effective and/or reliable removal of the clogging condition.

A further object of the present disclosure is to provide a method for handling a clogging condition in a dishwasher enabling the dishwasher to be less susceptive to failure due to excessive soil amounts in the dishwasher.

A still further object of the present disclosure is to provide a method for handling a clogging condition in a dishwasher that reduces the risk for the clogging condition to spread to other parts of the dishwasher, e.g. spray arms and a sump cavity.

A still further object of the present disclosure is to provide a dishwasher configured to handle a clogging condition that solves at least one of the above objects.

A still further object of the present disclosure is to provide a control system for handling a clogging condition in a dishwasher that solves at least one of the above objects.

According to one aspect, there is provided a method for handling a clogging condition in a dishwasher, the method comprising detecting the clogging condition; upon detecting the clogging condition, interrupting a wash cycle of the dishwasher and executing a remedial operation to remove the clogging condition. The remedial operation of the method further comprises executing a drain operation for a predetermined drain time during which a drain pump is continuously or intermittently operated to drain water from a sump of the dishwasher; following the drain operation, executing a fill operation for a predetermined fill time during which a fill valve is continuously or intermittently activated to add water to the dishwasher; and following the fill operation, executing a circulation operation during which a circulation pump is continuously or intermittently operated to remove the clogging condition.

Throughout the present disclosure, a clogging condition may be a clogging condition of a filter in the dishwasher. Alternatively, or in addition, a clogging condition may be a clogging condition of a turbidity sensor, a pressure sensor, sensor connections, pumps and various conduits in the dishwasher. In other words, a clogging condition may be a clogging condition of any component in the dishwasher where soils or other particles can gather to affect the water flow.

The method according to the present disclosure does not need to rely on signals from detection devices, e.g. water level sensors such as pressure sensors, when executing the remedial operation. Thus, according to one variant, the method comprises disregarding the signals from detection devices during the remedial operation. Once the wash cycle is resumed, the signals from the detection devices may be taken into account again, e.g. to detect a clogging condition once more.

Even though the dishwasher according to the present disclosure may comprise one or more detection devices, such as sensors, the method for handling the clogging condition may disregard the signals from these sensors. No confirmation from detection devices is needed to terminate the drain operation or the fill operation.

Instead, by executing the drain operation for a predetermined drain time and executing the fill operation for a predetermined fill time, the method uses a dead reckoning approach for the remedial operation. This is advantageous since there is a risk that the clogging condition makes the one or more detection devices unreliable.

The drain time and the fill time may each be set to take a clogging condition into account, i.e. to allow sufficient time for the water to enter the sump. In other words, the drain time may initially be set to a higher value, e.g. twice as high as a drain time when no clogging condition is present. Similarly, the fill time may initially be set to a higher value, e.g. twice as high as a fill time when no clogging condition is present. The drain operation and the fill operation of the remedial operation according to the present disclosure thereby ensures sufficient saturation of the circulation pump prior to executing the circulation operation and ensures that cleaner water is used for the circulation operation.

The detection of the clogging condition may be carried out in a number of ways. According to one example, the clogging condition of the filter is detected by observing a lack of water on the non-pressurized side of the circulation pump despite knowing enough water for pump saturation has been introduced into the dishwasher. In case a turbidity sensor is employed, the signal from the turbidity sensor indicates a clogging condition of the turbidity sensor and may or may not indicate a clogging condition of remaining components of the dishwasher (e.g. if only the turbidity sensor is clogged).

The remedial operation may be executed immediately upon detecting the clogging condition. Alternatively, the execution of the remedial operation may be delayed upon detecting the clogging condition.

The method according to the present disclosure may alternatively be referred to as a clogging response routine. Furthermore, the method may be implemented in any type of wash cycle, not only in intensive programs. The method may also be used to handle a clogging condition of one or several filters in the dishwasher.

The fill time may be based on historical data. The historical data may be constituted by historical data of one or more detection devices (e.g. a pressure sensor) and/or one or more circulation pump parameters during previous fill operations. According to one specific example, only historical data of one or more circulation pump parameters are used to determine and/or adjust the fill time.

According to a further example, based on historical data of one or more detection devices and/or one or more circulation pump parameters, an inflow may be calculated for each fill operation of previous wash cycles and used to adjust the fill time. This calculation may be carried out without a flow sensor.

Alternatively, or in addition, the fill time may be based on a nominal value. The nominal value of the fill time may be set when programming the wash cycle, e.g. during production. This nominal value of the fill time may then be adjusted based on historical data. The nominal value of the fill time may be used when no historical data is available.

The circulation pump may be operated according to a predefined circulation pattern and for a predefined circulation time during the circulation operation. Thus, also the circulation operation may be carried out according to a dead reckoning approach. In other words, the method does not need to rely on signals from detection devices, e.g. sensors, when executing the circulation operation.

The circulation time may be increased each time the circulation operation is executed during the wash cycle. A maximum circulation time and a minimum circulation time may be defined such that the circulation time is kept within this interval. When starting a new wash cycle, the circulation time at the end of a previous wash cycle may be maintained. Alternatively, the circulation time may be reset to a default value each time a new wash cycle is started. In this case, no minimum circulation time needs to be defined. If the circulation time at the end of a previous wash cycle is maintained when starting a new wash cycle, the circulation time may be decreased each time a wash cycle is completed without detecting a clogging condition. If a remedial operation is executed, the remaining time of the wash cycle may or may not be compensated such that the wash cycle is completed within a predefined target time.

The method may further comprise limiting the number of executed remedial operations during the wash cycle. Alternatively, or in addition, the method may further comprise limiting the number of executed remedial operations during at least one wash segment of the wash cycle.

A wash cycle according to the present disclosure may be constituted by a variety of wash cycles and include one or more wash segments. For example, a wash cycle may be constituted a normal wash cycle, a china/crystal wash cycle, an economy wash cycle, a speed wash cycle, an automatic wash cycle, etc.

In order to limit the number of executed remedial operations during the wash cycle and/or during the at least one wash segment of the wash cycle, one or two remedial operation counter values may be increased each time the remedial operation is executed. Prior to executing the remedial operation, the method may comprise a step of comparing the remedial operation counter value with a remedial operation counter limit. If the remedial operation counter value is lower than the remedial operation counter limit, the method allows execution of the remedial operation. If the remedial operation counter value is equal to, or higher than, the remedial operation counter limit, the method does not allow execution of the remedial operation, i.e. the number of remedial operations is limited.

A wash cycle remedial operation counter value may be provided to limit the number of executed remedial operations during the wash cycle by comparing the wash cycle remedial operation counter value with a wash cycle remedial operation counter limit. The wash cycle remedial operation counter value may be reset each time a new wash cycle is started.

Alternatively, or in addition, a wash segment remedial operation counter value may be provided to limit the number of executed remedial operations during the wash segment by comparing the wash segment remedial operation counter value with a wash segment remedial operation counter limit. The wash segment remedial operation counter value may be reset each time a new wash segment is started.

The method may further comprise determining a current position of the wash cycle being executed upon detecting the clogging condition; and resuming operation of the dishwasher based on the current position upon completion of the remedial operation.

The step of determining a current position of the wash cycle being executed may comprise a step of registering a water temperature. For this purpose, a temperature sensor may be provided in the dishwasher to measure the actual water temperature instead of using a target temperature of the current position of the wash cycle.

The step of resuming operation of the dishwasher based on the current position comprises resuming operation of the dishwasher from the water temperature. Prior to resuming operation of the dishwasher, the method may therefore also comprise a step of heating (or cooling) the water to the water temperature registered at the current position of the wash cycle. In other words, the operation of the dishwasher may be resumed from an actual water temperature, and not only a target water temperature, of the current position of the wash cycle.

The detection of the clogging condition may be made continuously throughout the wash cycle. This stands in contrast to prior art solutions where one or more clogging condition checks are planned as part(s) of the wash cycle.

The method may further comprise determining if the current position of the wash cycle is a predefined allowed position upon detection of the clogging condition; and interrupting the wash cycle and executing the remedial operation if the current position of the wash cycle is a predefined allowed position.

One or more allowed positions where the remedial operation is allowed to be executed may be defined, e.g. when programming the wash cycle. According to one variant, the one or more allowed positions may be defined as all positions of the wash cycle except one or more non-allowed positions. The non-allowed positions of the wash cycle may in turn be defined as positions of the wash cycle when the remedial operation should not be executed.

The fill valve may be continuously or intermittently activated to add water to a tub of the dishwasher during the fill operation. In other words, the fill valve may be activated to add water to a region upstream of the filter. Alternatively, the fill valve may be activated to add water to the sump, i.e. a region downstream of the filter.

According to a further aspect, there is provided a dishwasher configured to handle a clogging condition, the dishwasher comprising a control device configured to carry out any method according to the present disclosure. The dishwasher may comprise a tub, at least one filter, a sump, at least one drain pump to drain water from the sump, at least one fill valve to add water to the dishwasher, at least one spray arm and at least one circulation pump to recirculate water from the sump to the tub via spray arms.

The at least one fill valve may be arranged to add water into the tub of the dishwasher. Alternatively, the at least one fill valve may be arranged to add water into the sump of the dishwasher.

The dishwasher may further comprise at least one detection device. The at least one detection device may be constituted by a water level sensor such as a pressure sensor. The at least one detection device may be positioned upstream of the filter in the tub and/or downstream of the filter in the sump.

According to a further aspect, there is provided a control system for handling a clogging condition in a dishwasher, the control system comprising a data processing device and a memory having a computer program stored thereon, the computer program comprising program code which, when executed by the data processing device, causes the data processing device to perform the steps of: detecting the clogging condition; upon detecting the clogging condition, interrupting a wash cycle of the dishwasher and executing a remedial operation to remove the clogging condition. The remedial operation comprises executing a drain operation for a predetermined drain time during which a drain pump is continuously or intermittently operated to drain water from a sump of the dishwasher; following the drain operation, executing a fill operation for a predetermined fill time during which a fill valve is continuously or intermittently activated to add water to the dishwasher; and following the fill operation, executing a circulation operation during which a circulation pump is continuously or intermittently operated to remove the clogging condition. The program code may further be configured to, when executed by the data processing device, carry out any method according to the present disclosure.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
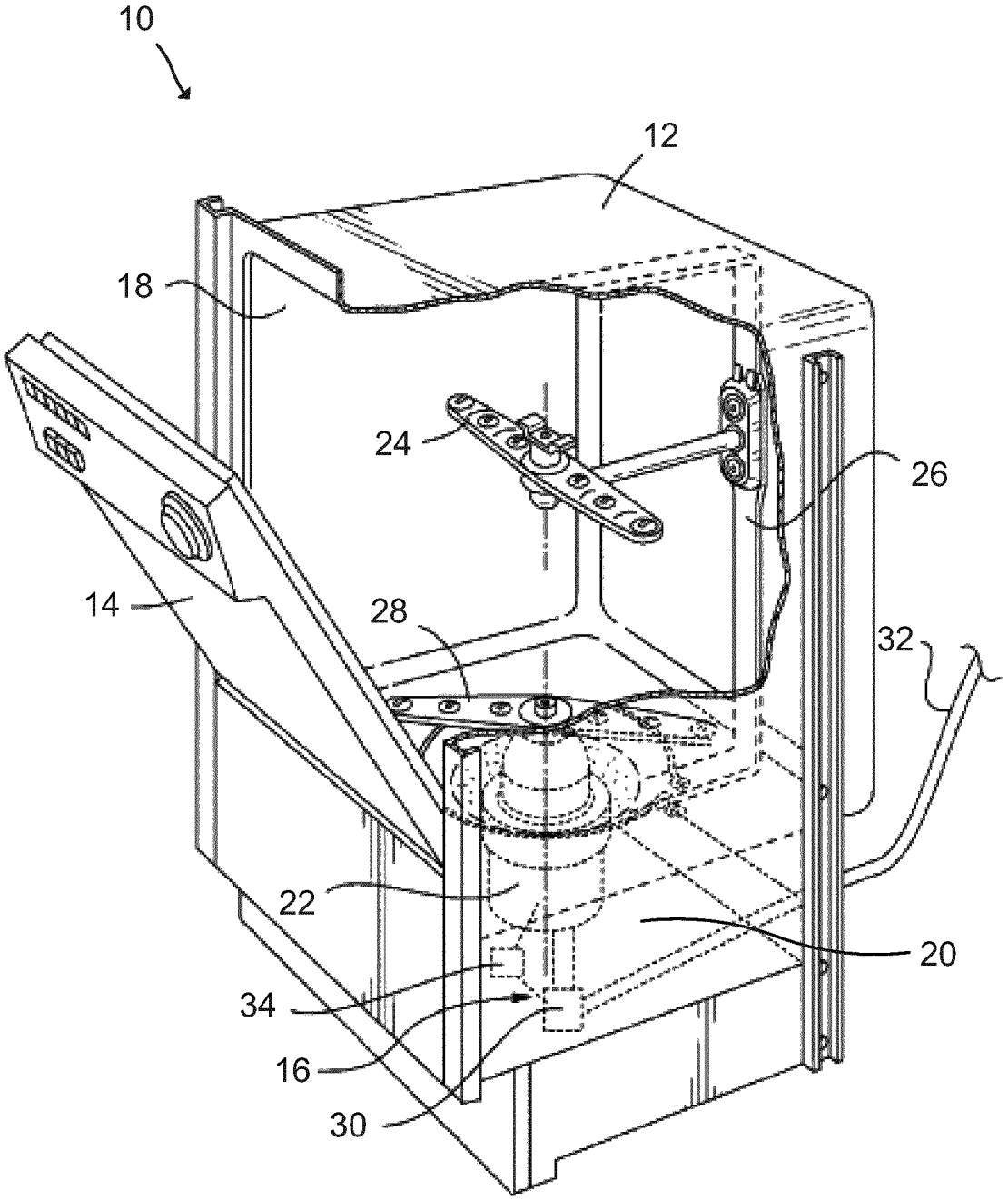
FIG. 1: schematically represents a perspective view of a dishwasher.

In the following, a method for handling a clogging condition in a dishwasher in which a remedial operation comprising a drain operation, a fill operation and a circulation operation is executed, a dishwasher configured to handle a clogging condition, and a control system for handling a clogging condition in a dishwasher, will be described. The same reference numerals will be used to denote the same or similar structural features.

FIG. 1 schematically represents a perspective view of one example of a dishwasher 10 according to the present disclosure. The dishwasher 10 is configured to implement any of the methods according to the present disclosure.

The dishwasher 10 comprises a tub 12 (partly broken away in FIG. 1 to show internal components of the dishwasher 10), a pivotable door 14 and a base portion 16. The tub 12 comprises a plurality of walls 18 for forming an enclosure in which dishes, utensils and other dishware may be placed for washing. The dishwasher 10 may also comprise slidable upper and lower racks (not shown) for holding the dishes, utensils and other dishware. Below the tub 12, a sump 20 is provided in which wash water or rinse water is collected, typically under the influence of gravity.

The dishwasher 10 further comprises a circulation pump 22, an upper spray arm 24, an upper circulation conduit 26 for establishing a fluid communication between the circulation pump 22 and the upper spray arm 24, a lower spray arm 28 and a lower circulation conduit (not shown) for establishing a fluid communication between the circulation pump 22 and the lower spray arm 28.

The dishwasher 10 further comprises a drain pump 30 for pumping water in the sump 20 to a drain hose 32. The drain hose 32 may be connected to a typical home drain plumbing system (not shown). FIG. 1 further shows a control system 34 arranged in the base portion 16. The control system 34 is used to control operation of the drain pump 30, a fill valve (not shown) and the circulation pump 22.

Figure 2:
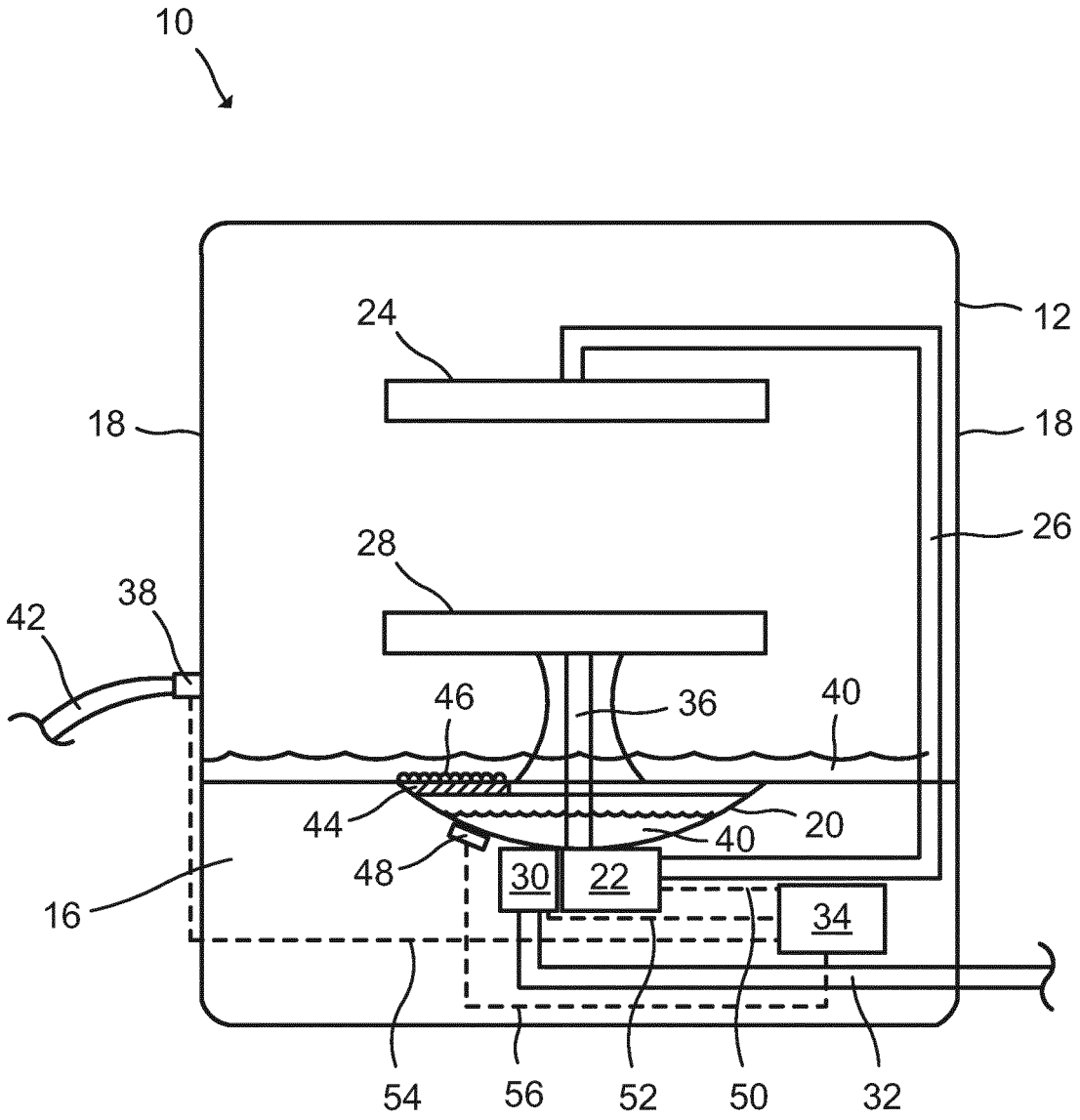
FIG. 2: schematically represents a cross sectional side view of the dishwasher.

FIG. 2 schematically represents a cross sectional side view of the dishwasher 10 in FIG. 1. As can be seen in FIG. 2, the drain pump 30 and the circulation pump 22 of the dishwasher 10 are arranged in immediate vicinity to the sump 20. However, alternative positions of the drain pump 30 and the circulation pump 22 are possible. FIG. 2 further shows the lower circulation conduit 36 that provides the fluid communication between the circulation pump 22 and the lower spray arm 28.

The dishwasher 10 comprises a fill valve 38 for being activated (e.g. opened or partly opened) in order to add water 40 from an inlet hose 42 into the dishwasher 10 or deactivated to close communication between the inlet hose 42 and the interior of the dishwasher 10. The inlet hose 42 may be connected to a water supply (not shown).

A filter 44 is provided between the tub 12 and the sump 20 to filter soils 46 from the water 40. The dishwasher 10 further comprises a detection device 48, here implemented as a pressure sensor, in order to detect a clogging condition of the filter 44. The detection device 48 is optional and parameters of the circulation pump 22 and or the drain pump 30 may alternatively be used to detect a clogging condition of the filter 44. The dishwasher 10 may also be configured to detect a clogging condition of components other than the filter 44.

In FIG. 2, the fill valve 38 is arranged to add water 40 into the tub 12, i.e. upstream of the filter 44. However, the fill valve 38 may alternatively be arranged to add water 40 directly into the sump 20, i.e. downstream of the filter 44. Furthermore, the detection device 48 is arranged in the sump 20 in FIG. 2 but the detection device 48 may alternatively be arranged, for example, in the tub 12.

The dishwasher 10 in FIG. 2 further comprises a circulation pump signal line 50 for signal communication between the control system 34 and the circulation pump 22, a drain pump signal line 52 for signal communication between the control system 34 and the drain pump 30, a fill valve signal line 54 for signal communication between the control system 34 and the fill valve 38 and a detection device signal line 56 for signal communication between the control system 34 and the detection device 48.

As illustrated in FIG. 2, the sump 20, the detection device 48, the drain pump 30, the circulation pump 22 and the control system 34 are provided in the base portion 16 of the dishwasher 10. However, an alternative positioning within the dishwasher 10 of one or more of these components is possible.

The dishwasher 10 may optionally comprise a chimney (not shown) to establish a fluid communication between the sump 20 and a height within the tub 12 close to an alarm level that indicates the occurrence a flooding condition of the dishwasher 10. The chimney may also be provided with a filter.

The control system 34 comprises a data processing device (not shown) and a memory (not shown). The memory has a computer program stored thereon having program code which, when executed by the data processing device, causes the data processing device to perform the steps of any of the methods according to the present disclosure.

During a typical wash cycle, the dishwasher 10 may provide water 40 through the circulation pump 22 to the upper and/or lower spray arms 24, 28 to cause water 40 to spray into the tub 12. The water 40 that is sprayed into the tub 12 falls, for example due to gravity, to the sump 20 and interacts with the filter 44. As the circulation pump 22 pumps the water 40, the water 40 may partially or fully pass through the filter 44 for soil collection. Although FIG. 2 only shows one filter 44, the dishwasher 10 may alternatively comprise several filters 44.

During the wash cycle, soils 46 (or other particles) might can become stuck on the filter 44 causing a clogging condition that prevents or slows water 40 from passing through the filter 44 to the circulation pump 22. A lower water level within the sump 20 might cause the circulation pump 22 to suck in air, which may make the discharge flow of the circulation pump 22 become intermittent or even to stop as the circulation pump 22 loses its prime. This may damage the circulation pump 22.

A clogging condition may be detected in various ways. In one example, a clogging condition of the filter 44 can be detected when the signals from the detection device 48 indicates that the water level in the sump 20 deviates from an expected value at a particular position of the wash cycle. Parameters of the drain pump 30 and/or the circulation pump 22 may also be used to detect a clogging condition, such as a clogging condition of the filter 44. A turbidity sensor (not shown) may also be provided in the dishwasher 10 to detect a clogging condition. The dishwasher 10 may be configured to continuously detect a clogging condition, e.g. a clogging condition of the filter 44, throughout the entire wash cycle.

Once a clogging condition has been detected, the method according to the present disclosure provides for an interruption of the wash cycle of the dishwasher 10 and an execution of a remedial operation to remove the clogging condition of the filter 44. The wash cycle may be interrupted immediately upon detection of the clogging condition. Alternatively, the wash cycle may wait for a predefined allowed position of the wash cycle before executing the remedial operation.

The remedial operation comprises a first step of executing a drain operation for a predefined drain time. During the drain operation, the drain pump 30 is driven continuously, for example at low speed, or intermittently, to pump water 40 from out from the sump 20 to the drain hose 32.

Once the drain operation is completed, i.e. when the drain time has lapsed, it is assumed that the sump 20 is empty or substantially empty and the remedial operation switches from the drain operation to a fill operation. In the fill operation, the fill valve 38 is opened continuously or intermittently to let fresh water 40 from the inlet hose 42 enter into the interior of the dishwasher 10. In the example of FIG. 2, the water 40 enters directly into the tub 12. The fill operation is executed during a predefined fill time. As mentioned above, the fill time can be predefined based on historical data and/or based on a nominal value.

Once the fill operation is completed, i.e. when the fill time has lapsed, it is assumed that the sump 20 contains a sufficient amount of water 40 to saturate the circulation pump 22 and the remedial operation switches from the drain operation to a circulation operation. In the circulation operation, the circulation pump 22 is driven (e.g. continuously and/or with pulses) to remove the clogging condition. Various modes of operations of the circulation pump 22 for removing clogging conditions are known. For example, the circulation pump 22 may be driven to spray water 40 onto the filter 44 via the lower spray arm 28 only.

However, in contrast to prior art circulation operations, the circulation pump 22 may be operated in the circulation operation for a predefined circulation time and/or with a predefined circulation pattern. In other words, the operation of the circulation pump 22 can be defined in advance such that the circulation operation is executed without using any sensor inputs, e.g. from the detection device 48.

The circulation time for the circulation operation may be increased each time the circulation operation is executed during the same wash cycle. If a clogging condition is detected and remedial operation (including a circulation operation) is executed a second time, this could be an indication that the previous circulation operation was not fully successful. For this reason, the circulation time can be increased each time the circulation operation is executed.

Throughout the wash cycle, or throughout one or more wash segments of the wash cycle, the number of executed remedial operations can be limited. This may for example be realized by using a remedial operation counter. Thereby, it can be avoided that the wash cycle is stopped in an infinite loop due to misleading clogged sensors.

Once a remedial operation has been executed, the wash cycle may be resumed based on the current position where the wash cycle was interrupted to execute the remedial operation. The dishwasher 10 may comprise a temperature sensor (not shown) to continuously register a water temperature, e.g. the temperature of the water 40 in the sump 20. Instead of resuming the wash cycle based on a target temperature of the current position where the wash cycle was interrupted, the actual temperature of the to water 40 can be used instead. This improves the cleaning performance of the dishwasher 10.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. A method for handling a clogging condition in a dishwasher, the method comprising:

detecting the clogging condition;

upon detecting the clogging condition, interrupting a wash cycle of the dishwasher and executing a remedial operation to remove the clogging condition;

wherein the remedial operation comprises:

executing a drain operation for a predetermined drain time during which a drain pump is continuously or intermittently operated to drain water from a sump of the dishwasher;

following the drain operation, executing a fill operation for a predetermined fill time during which a fill valve is continuously or intermittently activated to add water to the dishwasher;

following the fill operation, executing a circulation operation during which a circulation pump is continuously or intermittently operated to remove the clogging condition;

determining if the current position of the wash cycle is a predefined allowed position upon detection of the clogging condition; and interrupting the wash cycle and executing the remedial operation if the current position of the wash cycle is a predefined allowed position.

2. The method according to claim 1, wherein the clogging condition is a clogging condition of a filter in the dishwasher.

3. The method according to claim 1, wherein the fill time is based on historical data and/or a nominal value.

4. The method according to claim 1, wherein the circulation pump is operated according to a predefined circulation pattern and for a predefined circulation time during the circulation operation.

5. The method according to claim 4, wherein the circulation time is increased each time the circulation operation is executed during the wash cycle.

6. The method according to claim 1, further comprising limiting the number of executed remedial operations during the wash cycle.

7. The method according to claim 1, further comprising limiting the number of executed remedial operations during at least one wash segment of the wash cycle.

8. The method according to claim 1, wherein the method further comprises:

determining a current position of the wash cycle being executed upon detecting the clogging condition; and resuming operation of the dishwasher based on the current position upon completion of the remedial operation.

9. The method according to claim 8, wherein the step of determining a current position of the wash cycle being executed comprises a step of registering a water temperature.

10. The method according to claim 9, wherein the step of resuming operation of the dishwasher based on the current position comprises resuming operation of the dishwasher from the water temperature.

11. The method according to claim 1, wherein the detection of the clogging condition is made continuously throughout the wash cycle.

12. The method according to claim 1, wherein the fill valve is continuously or intermittently activated to add water to a tub of the dishwasher during the fill operation.

13. A dishwasher configured to handle a clogging condition, the dishwasher comprising a control system configured to carry out the method according to claim 1.

14. A control system for handling a clogging condition in a dishwasher, the control system comprising a data processing device and a memory having a computer program stored thereon, the computer program comprising program code which, when executed by the data processing device, causes the data processing device to perform the steps of:

detecting the clogging condition;

upon detecting the clogging condition, interrupting a wash cycle of the dishwasher and executing a remedial operation to remove the clogging condition;

wherein the remedial operation comprises:

executing a drain operation for a predetermined drain time during which a drain pump is continuously or intermittently operated to drain water from a sump of the dishwasher;

following the drain operation, executing a fill operation for a predetermined fill time during which a fill valve is continuously or intermittently activated to add water to the dishwasher;

following the fill operation, executing a circulation operation during which a circulation pump is continuously or intermittently operated to remove the clogging condition;

determining if the current position of the wash cycle is a predefined allowed position upon detection of the clogging condition; and interrupting the wash cycle and executing the remedial operation if the current position of the wash cycle is a predefined allowed position.

* * * * *